US008960663B2

(12) United States Patent
Haupt-Terlau

(10) Patent No.: US 8,960,663 B2
(45) Date of Patent: Feb. 24, 2015

(54) SHEET FEEDER WITH TWO SUCTION WHEELS

(71) Applicant: Heidelberger Druckmaschinen AG, Heidelberg (DE)

(72) Inventor: Martin Haupt-Terlau, Erdmannhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/709,217

(22) Filed: Dec. 10, 2012

(65) Prior Publication Data

US 2013/0147108 A1 Jun. 13, 2013

(30) Foreign Application Priority Data

Dec. 8, 2011 (DE) ..... 10 2011 120 475

(51) Int. Cl.

| | |
|---|---|
| ***B65H 3/40*** | (2006.01) |
| ***B65H 5/12*** | (2006.01) |
| ***B65H 3/08*** | (2006.01) |
| ***B65H 3/10*** | (2006.01) |
| ***B65H 5/22*** | (2006.01) |

(52) U.S. Cl.

CPC ..... *B65H 5/12* (2013.01); *B65H 3/0825* (2013.01); *B65H 3/10* (2013.01); *B65H 5/226* (2013.01); *B65H 2406/33* (2013.01); *B65H 2511/22* (2013.01); *B65H 2801/24* (2013.01)

USPC ..... 271/93; 271/91; 271/95; 271/90; 271/107; 271/112

(58) Field of Classification Search

USPC ..... 271/11, 90, 91, 93–98, 102, 105–108, 271/112

See application file for complete search history.

(56) References Cited

U.S. PATENT DOCUMENTS

| | | | | |
|---|---|---|---|---|
| 2,313,100 | A * | 3/1943 | Stevens | 271/93 |
| 2,849,232 | A * | 8/1958 | Halahan et al. | 271/98 |
| 4,580,770 | A * | 4/1986 | Warden et al. | 270/52.02 |
| 6,918,581 | B2 * | 7/2005 | Horiuchi | 271/96 |
| 8,025,285 | B2 * | 9/2011 | Hiramitsu et al. | 271/96 |
| 2008/0012202 | A1 | 1/2008 | Hubl et al. | |
| 2008/0296829 | A1 * | 12/2008 | Asari et al. | 271/95 |
| 2010/0075821 | A1 | 3/2010 | Terlau | |
| 2011/0254220 | A1 | 10/2011 | Asari et al. | |
| 2013/0147109 | A1 * | 6/2013 | Haupt-Terlau | 271/96 |

FOREIGN PATENT DOCUMENTS

| | | | |
|---|---|---|---|
| DE | 29 40 360 | A1 | 4/1981 |
| DE | 196 32 657 | C1 | 9/1997 |
| DE | 196 48 742 | A1 | 5/1998 |
| DE | 10 2004 041 471 | A1 | 4/2005 |
| DE | 10 2006 016 100 | A1 | 10/2007 |
| DE | 10 2006 055 301 | A1 | 5/2008 |
| DE | 10 2008 048 287 | A1 | 3/2010 |

OTHER PUBLICATIONS

German Patent and Trademark Office Search Report, Dated July 24, 2012.

* cited by examiner

*Primary Examiner* — Ernesto Suarez

(74) *Attorney, Agent, or Firm* — Laurence A. Greenberg; Werner H. Stemer; Ralph E. Locher

(57) ABSTRACT

A sheet feeder for separating sheets from a stack and for feeding the sheets to a downstream sheet processing machine includes a first suction wheel and a second suction wheel. The first suction wheel is disposed above the stack and the second suction wheel is disposed downstream of the stack and below a sheet travel plane. The first suction wheel separates a respective sheet from the stack and the second suction wheel accelerates the sheet.

9 Claims, 4 Drawing Sheets

SHEET FEEDER WITH TWO SUCTION WHEELS

CROSS-REFERENCE TO RELATED APPLICATION

This application claims the priority, under 35 U.S.C. §119, of German Patent Application DE 10 2011 120 475.3, filed Dec. 8, 2011; the prior application is herewith incorporated by reference in its entirety.

BACKGROUND OF THE INVENTION

1. Field of the Invention

The invention relates to a sheet feeder for separating sheets of paper, cardboard, plastic and the like from a stack and for feeding the sheets in a sheet travel direction in a sheet travel plane to a downstream sheet processing machine. The sheet feeder includes a first suction wheel as viewed in the sheet travel direction and a second suction wheel as viewed in the sheet travel direction. The first suction wheel is disposed above the stack and the second suction wheel is disposed downstream of the stack and above or below the sheet travel plane.

2. Description of the Related Art

Buckle folders are known in the art. The structure of a buckle folder including a plurality of buckle folding units is disclosed in German Patent Application DE 10 2004 041 471 A1. A buckle folding unit is formed of a buckle plate and three folding rollers disposed to form two pairs of folding rollers. Knife folders are likewise known in the art. A single-knife folding unit for folding printed and pre-folded sheets is known from German Patent Application DE 29 40 360 A1. Combination folders combine bucket folding units and knife folding units. In a first folding station, parallel folds are created in buckle folding units and in a downstream folding station, cross folds are created in knife folding units. German Patent Application DE 10 2006 055 301 A1 discloses combination folders including a plurality of buckle folding units and downstream knife folding units.

Known sheet feeders for sheet-fed printing presses and so-called stack feeders for sheet-fed folders include a suction head equipped with combined lifting/dragging suction elements for separating sheets and accelerating separated sheets. A disadvantage of such alternating systems is that the dragging suction element carries out a reciprocating movement and can only transport a sheet during the advancing movement. No sheet can be transported during the return movement, which is a resetting movement of the dragging suction element and represents dead time. If the number of cycles of the sheet feeder is to be increased, i.e. if the throughput of the sheet feeder is to be improved and more sheets are to be fed per unit of time, the speed of the advancing and return movement of the dragging suction unit needs to be increased. The speed increase of the dragging suction unit is mechanically limited due to the translatory, alternating sequence of motions.

A common way of increasing the throughput or productivity of folders is to increase the speed at which the sheets are transported through the folder. An increased speed causes deformations and damage to a respective signature, which may result in transportation problems and a significant deterioration of the quality of the final products.

German Patent Application DE 10 2008 048 287 A1, corresponding to U.S. Patent Application Publication No. 2010/0075821, discloses a sheet feeder for a folder that includes a suction element for lifting and separating sheets in the area of the rear edge of a stack of sheets and a suction wheel in the front area of the stack. An adjustment of the position of the suction wheel permits modification of the degree of overlap between the sheets that are transported over a downstream transport table to a downstream folder. More overlap results in a greater throughput without a need to increase the sheet speed, thus avoiding any negative effect on the quality of the signatures.

SUMMARY OF THE INVENTION

It is accordingly an object of the invention to provide a sheet feeder with two suction wheels which overcomes the hereinafore-mentioned disadvantages of the heretofore-known devices of this general type and which operates with high reliability independently of the quality of the sheet-shaped material to be processed and with increased throughput (i.e. an increased number of sheets fed per unit of time) in a cost-efficient way and at low energy consumption. A further object is to permit the feeding of shingled or overlapping sheets.

With the foregoing and other objects in view there is provided, in accordance with the invention, a sheet feeder for separating sheets of paper, cardboard, plastic and the like, from a stack having front and rear edges and for feeding the sheets in a sheet travel direction in a sheet travel plane to a downstream sheet processing machine. The sheet feeder comprises a first suction wheel disposed above the stack and having an axis of rotation, a second suction wheel disposed downstream of the first suction wheel in the sheet travel direction, disposed downstream of the stack, disposed above or below the sheet travel plane and having an axis of rotation, and a separation device disposed in vicinity of the rear edge of the stack and configured to lift a respective uppermost sheet off the stack. The axis of rotation of the first suction wheel is disposed at a first distance from the rear edge of the stack, the axis of rotation of the second suction wheel is disposed at a second distance from the front edge of the stack and the first distance is greater than or equal to the second distance.

The sheet feeder of the invention is used to separate sheets of paper, board, plastic and the like from a stack and to feed the sheets in a direction of sheet travel and in a plane of sheet travel to a downstream machine for processing sheets such as a folder. The sheet feeder advantageously has a first suction wheel as viewed in the direction of sheet travel and a second suction wheel as viewed in the direction of sheet travel, the first suction wheel being disposed above the stack and the second suction wheel being disposed downstream of the stack as viewed in the direction of sheet travel and above or preferably below the plane of sheet travel. A configuration below the plane of sheet travel is preferred because it permits a shingled feeding of sheets. Each suction wheel is used to attract and transport the sheets by suction. Return movements causing dead time are no longer necessary. The use of rotating suction wheels that may be continuously operated may thus result in a significant increase of the throughput of the sheet feeder, i.e. in an accelerated operating cycle of the sheet feeder.

In the present disclosure, a suction wheel is understood to include a suction wheel with a revolving belt in a device for removing sheets from a stack as disclosed in German Patent DE 196 32 657 C1 and German Patent Application DE 196 48 742 A1.

The sheet feeder of the invention is equipped with a separator device disposed in the region of the rear edge of the stack. The separator device is used to lift a respective uppermost sheet off of the stack at its trailing edge and may be any type of lifting suction element known in the art or particularly effective blown-air nozzles.

A first distance A between an axis of rotation of the first suction wheel and the rear edge of the stack is advantageously greater than or at least equal to a second distance B between an axis of rotation of the second suction wheel and the front edge of the stack with the distances A, B being measured in the horizontal. This ensures that a respective sheet may be gripped by the second suction wheel in the region of the leading edge of the sheet before the first suction wheel releases the sheet in the region of its trailing edge. A respective sheet may thus be transferred from the first suction wheel to the second suction wheel in a defined way and may thus be reliably transported.

In accordance with another particularly advantageous and thus preferred feature of the sheet feeder of the invention, at least one suction and conveying section is provided on the periphery or about the circumference of the first suction wheel. The distance between the axis of rotation of the first suction wheel and the rear edge of the stack is approximately equivalent to the length of the at least one suction and conveying section, which only constitutes part of the circumference and does not extend over the entire circumference. In the remaining section of the periphery or circumference, a release section is provided, which does not have a suction effect and acts to transfer the sheet to the second suction wheel. This ensures that due to the action of the suction and conveying section, the first suction wheel transports a respective uppermost sheet until the trailing edge of the sheet leaves the effective range of the suction and conveying section so that the next sheet, i.e. the one below the sheet that has just been removed, can be attracted by suction by the first suction wheel.

In accordance with a further particularly advantageous and thus preferred feature of the sheet feeder of the invention, during operation of the sheet feeder the average rotational speed of the second suction wheel is higher than the average rotational speed of the first suction wheel, and the current rotational speed of the second suction wheel is always higher than the current rotational speed of the first suction wheel. This embodiment advantageously allows a respective sheet to be securely gripped and separated by the first suction wheel at a reduced speed and then to be accelerated by the second suction wheel up to the speed of the machine processing printing material that is disposed downstream of the sheet feeder. In a borderline case, the speeds of rotation are at least equal. For this purpose, a first drive may be provided for the first suction wheel and a second drive may be provided for the second suction wheel. For example, both drives may be servomotors. Alternatively, one electric motor may be provided and a gearing mechanism may be disposed between the electric motor and the respective suction wheel.

In accordance with an added feature of the sheet feeder of the invention, the sheet feeder includes a vacuum source that is connected at least to the first suction wheel by lines and continuously applies suction air to the first suction wheel during operation of the sheet feeder.

In accordance with an additional alternative feature, the sheet feeder includes a vacuum source that is connected at least to the first suction wheel by lines and cyclically applies suction air to the first suction wheel.

In accordance with yet another particularly advantageous feature, at least the following three cycles are provided: attracting a sheet by suction—holding and transporting the sheet—releasing/transferring the sheet. For this purpose, a control valve connected to a machine control unit by data lines or a valve coupled to the rotary movement of the first suction wheel may be provided. In the former case, corresponding actuation rules are stored in the machine control unit.

In accordance with yet a further development of this alternative, the sheet feeder has a machine control unit and a servomotor that is connected to the machine control unit by data lines and drives the first suction wheel. The servomotor is actuatable and is actuated in such a way that it imparts a rotary movement to the suction wheel only during the "holding the sheet" cycle. During the "attracting the sheet" and "releasing the sheet" cycles, the suction wheel does not rotate. Thus, any relative movement between the first suction wheel and the sheet is prevented when the sheet is being gripped and released, to avoid marking the sheet.

In accordance with yet an added development of an embodiment having a suction wheel that continuously exercises a suction effect, the sheet feeder has a drive that is connected to the first suction wheel for rotating the first suction wheel at a constant rotational speed. Since this alternative is much easier to control, it constitutes a particularly robust and stable configuration.

In accordance with an advantageous additional development of a sheet feeder described above, the sheet feeder includes side edge blowers disposed in the region of the side edges of the stack. These side edge blowers direct blown air to the stack to aerate it. Each side edge blower includes a nozzle body, which is supported for rotation on an axis and includes a plurality of multidirectional nozzles, and an air guide plate connected to the nozzle body. Multidirectional nozzles are understood to be nozzles having air jets which act in various and different directions. This advantageously ensures that at least one jet of blown air meets the side edge of the stack of sheets at an approximately right angle and thus has an effect and contributes to the creation of an air cushion between the sheets.

The invention also relates to a method of operating a sheet feeder constructed as described above.

The invention as described above and the advantageous further developments of the invention described above may be combined in any desired way. All combinations of aspects of the invention form advantageous further developments of the invention.

Further advantages and embodiments that are advantageous in structural and functional terms become apparent from the dependent claims and from the description of exemplary embodiments with reference to the associated drawings.

Other features which are considered as characteristic for the invention are set forth in the appended claims.

Although the invention is illustrated and described herein as embodied in a sheet feeder with two suction wheels, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
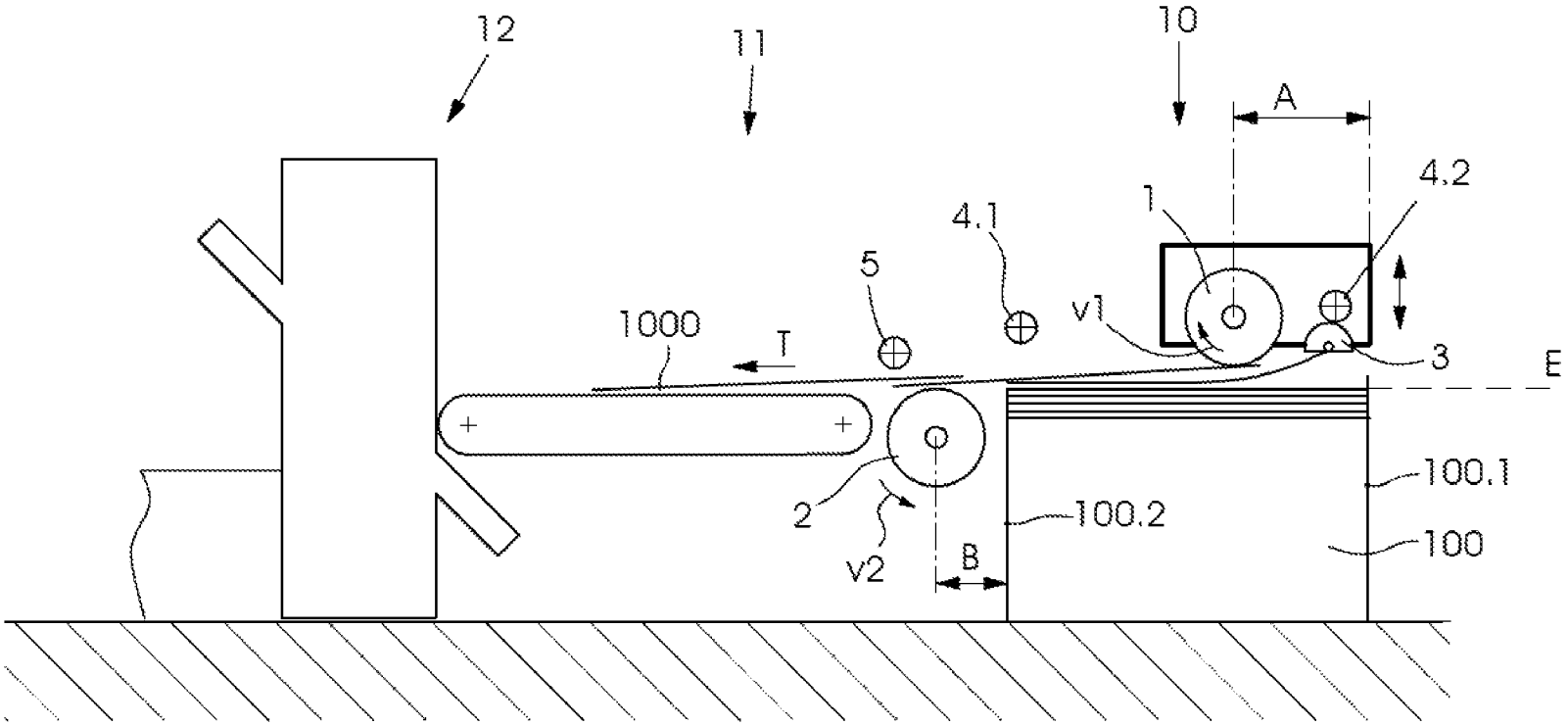
FIG. 1 is a fragmentary, diagrammatic, longitudinal-sectional view of a sheet feeder of the invention and a downstream folder.

Referring now in detail to the figures of the drawings, in which like elements have like reference symbols, and first, particularly, to FIG. 1 thereof, there is seen a sheet feeder 10 of the invention for separating sheets 1000 from a stack 100 of sheets and for feeding the separated sheets 1000 over a feed table 11 to a machine 12 for processing sheets. The illustrated machine 12 for processing sheets is a buckle folding unit in a sheet-fed folder. The sheet feeder 10 includes a first suction wheel 1 and a second suction wheel 2. The first suction wheel 1 is disposed above the stack 100 of sheets. The second suction wheel 2 is disposed below a plane E of sheet travel and downstream of the stack 100 as viewed in a direction of sheet travel T. The axis of rotation of the first suction wheel 1 is at a first distance A from a rear edge 100.1 of the stack 100 of sheets. The second suction wheel 2 is disposed at a second distance B from a front edge 100.2 of the stack 100 of sheets. The distance A is greater than or at least equal to the distance B to ensure that an uppermost sheet 1000 in the stack 100 is gripped by the first suction wheel 1 and reliably transferred to the second suction wheel 2 before a subsequent sheet 1000 is attracted by suction by the first suction wheel 1 and transported by the latter. The sheet feeder 10 includes two height sensors 4.1 and 4.2, which are provided to indicate that the stack 100 needs to be lifted and to adapt the height of a unit formed of the first suction wheel 1 and a lifting/separating unit 3. The lifting/separating unit 3 is disposed in the region of the rear edge 100.1 of the stack 100 of sheets and is used to lift a respective uppermost sheet 1000 off of the sheet stack 100 to separate that uppermost sheet from the stack of sheets. A sensor 5 for detecting double or multiple sheets as well as the distance between individual sheets and/or the degree of overlap between the sheets is provided downstream of the second suction wheel 2. When the sensor 5 detects a fault, at this point the sheet 1000 in question may be discharged or its position in the stream of sheets may be corrected.

As is indicated by the arrows of rotation, the first suction wheel 1 is rotated at a rotational speed v1 and the second suction wheel 2 is rotated at a rotational speed v2. The rotational speed v1 is always lower than or at least equal to the rotational speed v2. That is to say that the first suction wheel 1 attracts a sheet 1000 by suction and transports it at a lower rotational speed v1 to ensure greater accuracy and less danger of damage to the sheet 1000. Then the sheet 1000 is accelerated significantly due to the significantly higher rotational speed v2 of the second suction wheel 2. Advantageously, the second suction wheel 2 may accelerate the sheet 1000 up to the production speed of the folding unit 12. Selecting an appropriate speed difference between the speeds v2 and v1 is a way to adjust the distance between the sheets 1000 conveyed individually or the degree of overlap of sheets conveyed in a shingled stream.

Figure 2:
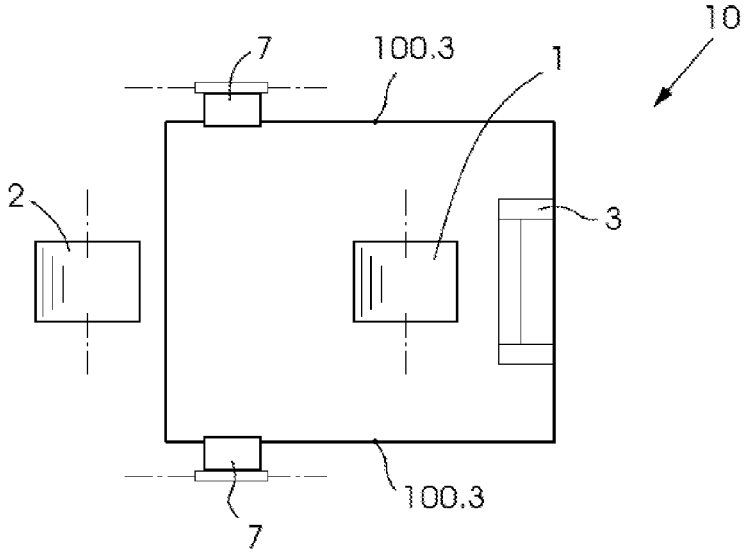
FIG. 2 is a plan view of the sheet feeder.

FIG. 2 is a plan view of the sheet feeder 10 of the invention. The sheet feeder 10 has additional side edge blowers 7 in the region of side edges 100.3 of the stack 100 of sheets. These side-edge blowers 7 are provided to aerate the stack 100 of sheets and in particular to create an air cushion between the uppermost sheet 1000 and the sheet underneath the uppermost sheet to ensure that the sheets 1000 are reliably separated. One possible embodiment of such a side edge blower 7 will be explained in more detail below with reference to FIG. 4.

Figure 3:
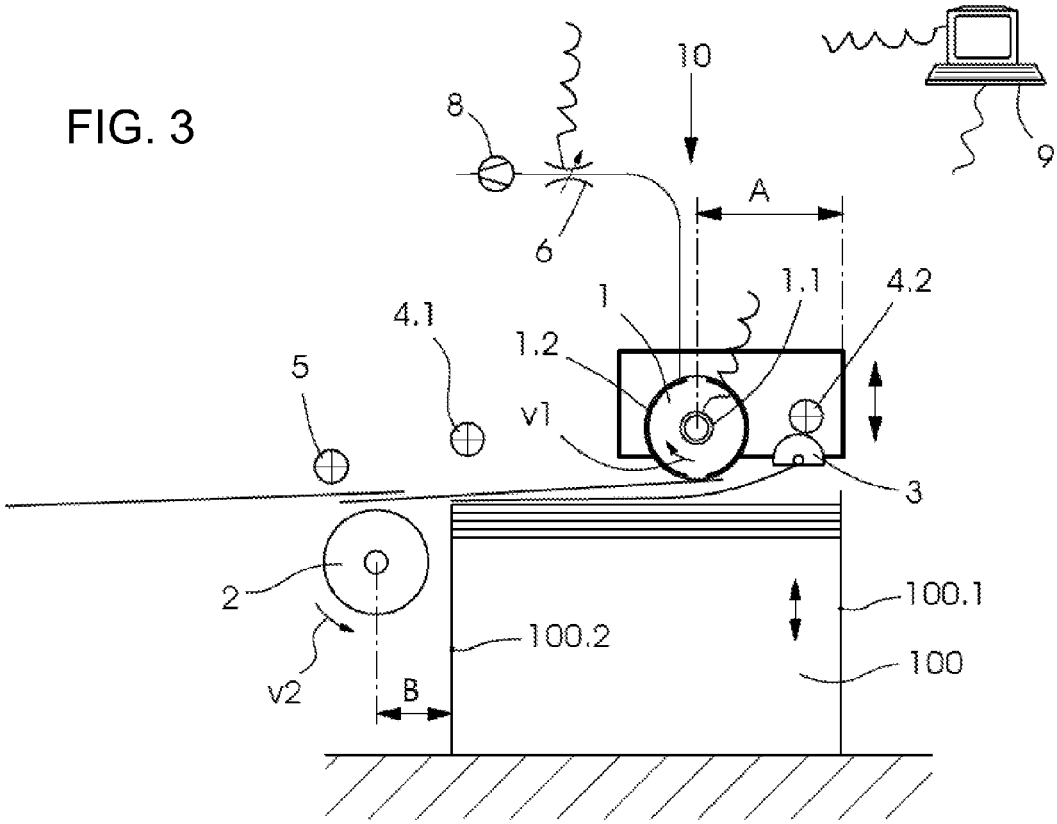
FIG. 3 is a longitudinal-sectional view of the sheet feeder.

FIG. 3 is a fragmentary view of the sheet feeder 10. A vacuum source 8 supplies suction air to the first suction wheel 1. The second suction wheel 2 is likewise supplied with suction air, potentially by the same vacuum source 8 (although a connection to the vacuum source 8 is not shown). If the supply of suction air to the first suction wheel 1 is not to be continuous, a control valve 6 may be provided between the vacuum source 8 and the first suction wheel 1 in a suction air duct. Such a control valve 6 permits an application of suction air to the first suction wheel 1 only at specific operating instants. The control valve 6 is connected to a machine control unit 9. In addition, the suction wheel 1 is driven by an electric motor 1.1, which may be a servomotor. This drive 1.1 is likewise connected to the machine control unit 9. The first suction wheel 1 includes a number of suction and conveying sections 1.2. The number of conveying sections 1.2 depends on whether one sheet 1000 or more sheets 1000 are to be sucked up and transported during one revolution of the first suction wheel 1. For example, if the first suction wheel 1 has two suction and conveying sections 1.2, the first suction wheel 1 successively separates and transports two sheets 1000 during one revolution.

Figure 4:
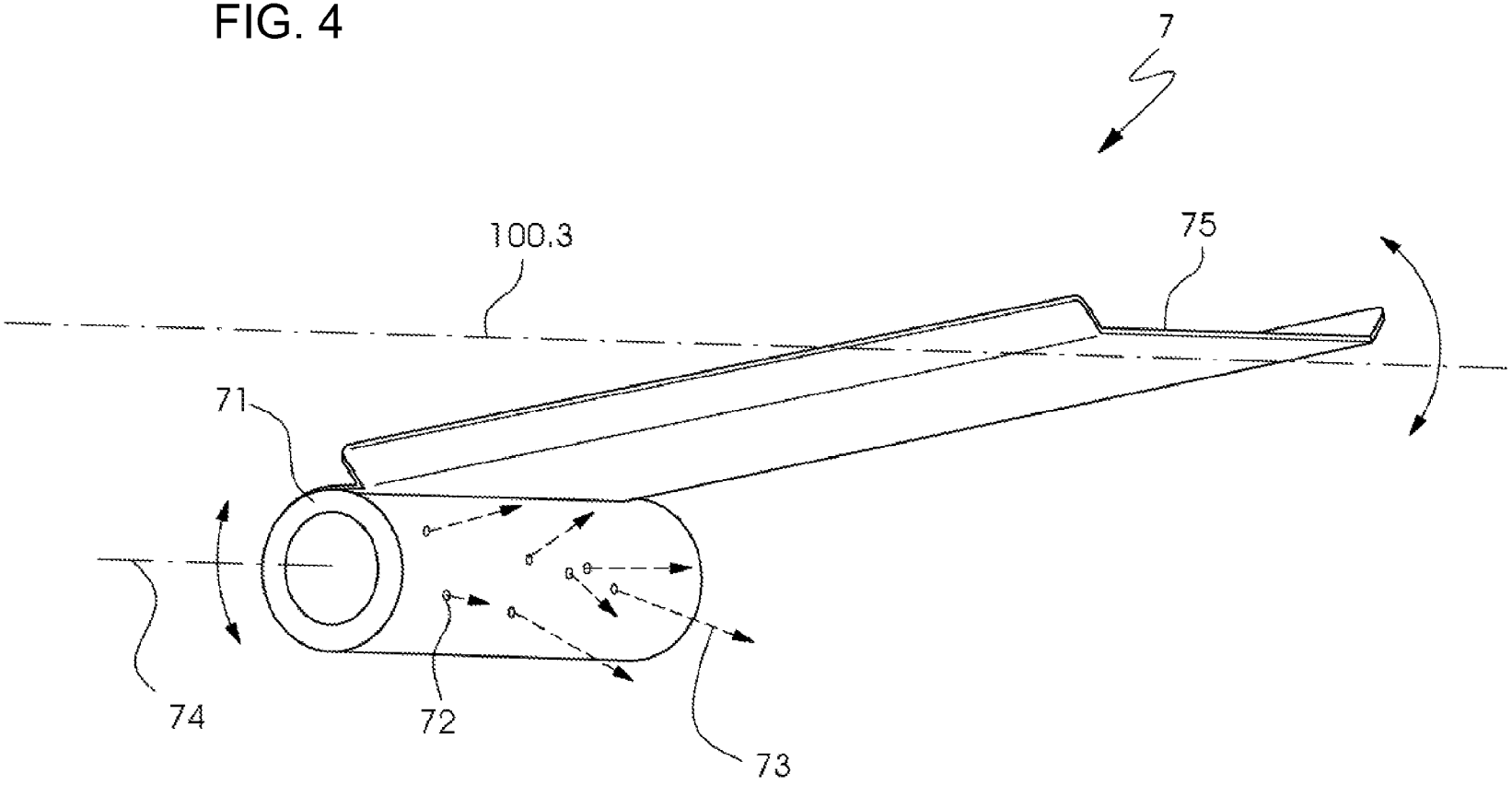
FIG. 4 is an enlarged, perspective view of a side edge blower of the sheet feeder.

FIG. 4 shows one possible embodiment of a side edge blower 7. The side edge blower 7 includes a nozzle body 71, which is rotatable about an axis of rotation 74. A number of multidirectional nozzles 72 are provided in this nozzle body 71. Blown air 73 emerges from the nozzles 72. The blown air 73 is directed to a side edge 100.3 of the stack 100 to aerate the stack 100 of sheets 1000. An air guide plate 75 is connected to the nozzle body 71. The air guide plate 75 may carry out the aforementioned rotary movement about the axis of rotation 74 together with the nozzle body 71. The air-guiding plate 75 directs the blown air 73 emerging from the nozzles 72 towards the stack 100 of sheets. The illustration shows that the blown-air jets 73 emerging from the nozzles 72 have different directions. This ensures that despite the rotation of the nozzle body 71, at least one blown-air jet 73 will hit the side edge 100.3 of the stack in such a way that the blown air 73 gets between the respective sheets 1000 and an air cushion can be formed between the sheets 1000.

Figure 5:
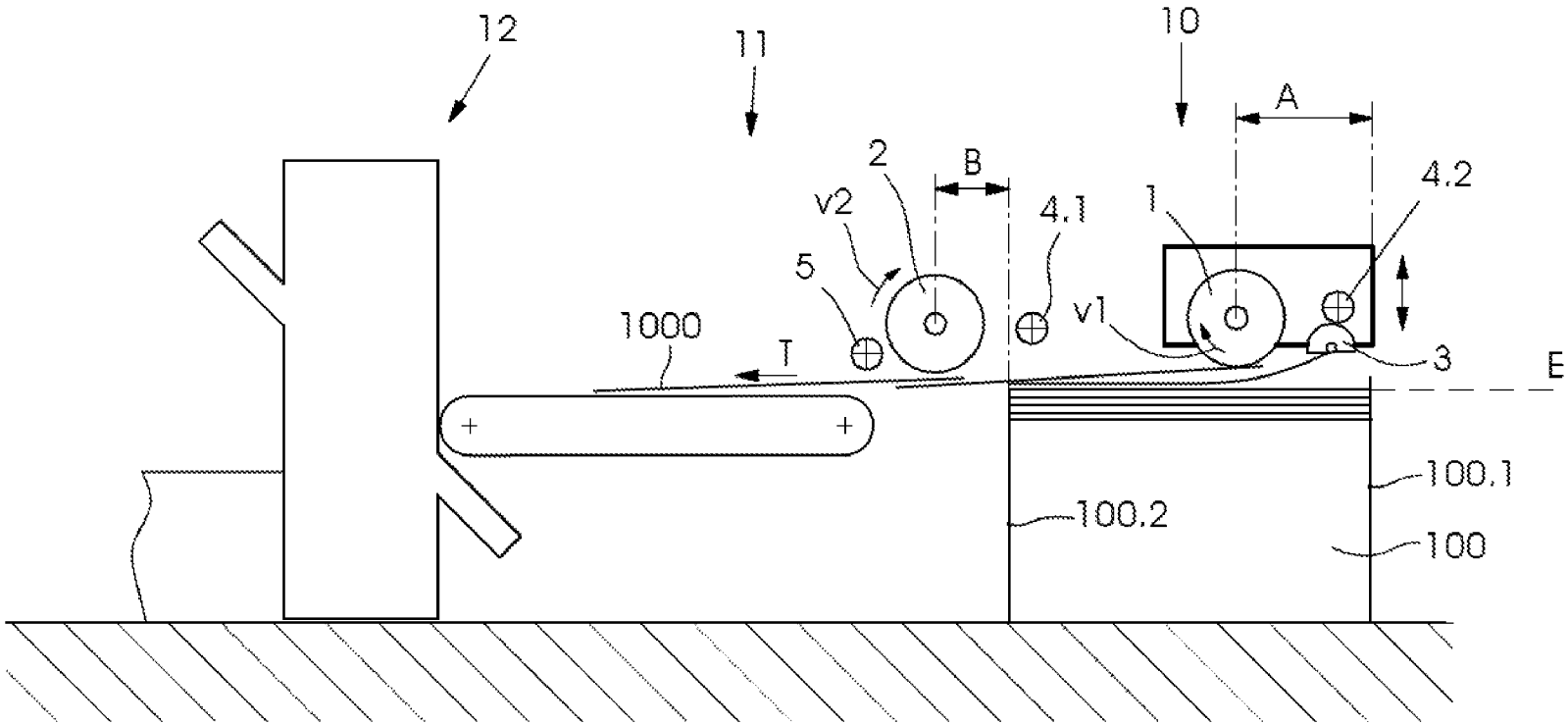
FIG. 5 is a longitudinal-sectional view of an alternative sheet feeder with a folder.

FIG. 5 illustrates an alternative sheet feeder 10. In contrast to the embodiment shown in FIG. 1, the second suction wheel 2 is disposed above the plane E of sheet travel.

A first suction wheel 1, which is disposed above the sheet to be conveyed, attracts, separates and conveys the sheets. A lifting unit 3 is disposed between the rear edge of the sheet and the suction wheel in the upper region. A lower second suction wheel 2 is disposed below the sheet to be conveyed and at a dependent distance B in front of the leading edge of the sheet to be conveyed. The distance B is smaller than or equal to a distance A, which is determined as a function of the conveying section (region on the circumference) of the first suction wheel 1.

The upper first suction wheel 1 may have a round shape or a non-round shape and may have a number of conveying sections distributed along the circumference. The rotation of the first suction wheel 1 and thus the conveying action itself may be controlled in terms of time, or it may be continuous or cyclical.

Suction-free transfer zones are required to transfer the sheets from the upper first suction wheel 1 to the lower second suction wheel 2 (as the upper suction wheel releases the sheet and the lower suction wheel takes over the transporting of the sheet). These suction-free transfer zones may be provided by using a separate suction cycle valve or by using clearly defined suction-free zones in the suction wheel itself.

The upper first suction wheel rotates at a constant speed v1. However, it may be driven cyclically by a servo drive, i.e. it may move through defined conveying paths at a non-uniform speed.

The function of the upper suction wheel 1 is to drag the sheets along. The suction elements for lifting the sheet and the conveying device are not coupled to each other.

The lower suction wheel 2 rotates at a uniform speed v2, with v2 always being higher than or equal to v1. A constant spacing between sheets or a desired degree of overlap can be attained by varying the speed difference between the speeds v1, v2 and as a function of the length of the sheets.

Moreover, due to the fact that the speeds v1 and v2 of the upper and lower suction wheels can be controlled independently of each other, i.e. that the speed of the feeder and the speed of the downstream machine for processing sheets are not coupled, a set-up operation can be implemented at a defined machine speed, for example folding unit speed.

In other words: the sheet feeding speed is uncoupled from the speed of the downstream processing device.

The removal of sheets from the feeder may be started at a low speed adapted to the start-up conditions. The folder, at the speed v2, may independently run at production speed right from the start and may thus produce production quality without any speed adaptations. The step-by-step increase of the sheet feeding speed is exclusively implemented by increasing the speed of the upper suction wheel.

Modifications of the folding process due to an increase of the feeder speed are no longer necessary.

The process of separating and feeding sheets is carried out as follows:

At first, a defined separation and pre-aeration period is initiated at the start-up of the feeder 10.

No sheets are conveyed during this period.

Static friction between the sheets 1000 to be conveyed in the stack 100 is reduced by side-edge, rear-edge, and separator blowers.

For this purpose, the stack of sheets is surrounded on its sides by a combination of sheet-guiding elements and blown-air nozzles.

These lateral elements center the sheets to be conveyed both in terms of their lateral alignment and in terms of their height and prevent any lateral misalignment or rising of the aerated upper layer of sheets.

The lateral elements may be positioned against the side edges as a function of the length and width of the sheet format.

For this purpose, parts of the side and height stops are moved out of the plane of operation.

The aeration nozzles integrated into the side and height stops are automatically deactivated by this process.

The aeration nozzles 7 adapt to the respective shape of the stack by modifying the blown-air angle. This is achieved through the use of the air guide plate that is lifted by the sheet to be conveyed.

The aeration air is controlled as a function of the conveying condition and may be applied cyclically or continuously.

The sheet to be conveyed is preferably separated from the upper plane of the stack by the aeration air before the beginning of the conveying operation to ensure that the sheet can be conveyed without frictional resistance. For this purpose, the lateral aeration nozzles direct air at a high pressure against the upper plane of the stack for a short period of time. This allows the jet of aeration air to enter as far as the center of the stack to separate the sheet from the stack of sheets. Due to the small amount of air, the stack does not expand excessively and there will be no disturbances to the conveying process.

In a subsequent step, the lifting unit is activated. A vacuum is created and the sheet to be conveyed is lifted at the trailing edge and held for a defined period of time.

Separating air is blown between the lifted sheet and the stack of sheets in a defined way. The upper sheet is separated from the stack of sheets and lifted against the upper suction wheel by the separating air.

The sheet that has been prepared to be conveyed in this way may now be engaged and conveyed by the suction zone of the first suction wheel. In the case of a controlled suction wheel drive, the suction process may occur during the resting period, i.e. when the suction wheel is at a standstill.

The conveying of the sheet only begins when the suction process has been completed and the sheet rests against the first suction wheel.

Due to the rotary movement of the upper suction wheel, the suction zone takes effect to suck the sheet against the suction wheel, to hold it there, and to convey it. Alternatively, this function may be activated by a suction air control unit.

At the same time, at the lifting unit the vacuum of the lifting suction elements is reduced by blown air (disturbing air) and the sheet is released to be conveyed. During the process, the lifting suction elements remain in their upper position. They do not move into the lower position until the sheet has left the region of the lifting suction element.

The aeration nozzles separate the sheets in the stack from each other shortly before the lifting suction elements are in their dead center. This separation process is only deactivated when the upward movement has begun. When the upper lifting suction element position has been reached, the separation-air nozzles are activated and the sheet to be conveyed is separated from the stack through the use of air. In the process, the uppermost sheet is lifted off of the stack to rest against the first suction wheel.

The suction wheel itself conveys the previous sheet and transfers it to the lower suction wheel at the end of the conveying distance. Then the lower suction wheel takes over the sheet and speeds it up to a speed v2.

During the transfer, the rotary movement of the upper suction wheel acts to disrupt the application of the vacuum so that the sheet can be accelerated to the speed v2 by the lower suction wheel without being subjected to any other forces. When the transfer is completed, the vacuum is re-applied due to the further rotary movement of the upper suction wheel. Alternatively, this function may be activated by a suction-air control unit, for example through the use of controllable valves.

In a parallel process, disturbing air blows the sheet off of the lifting suction elements and the sheet is conveyed by the upper suction wheel.

Subsequently, the process will start over at the beginning.

An additional component of the sheet feeder 10 will be examined in more detail below:

A sensor is disposed downstream of the lower suction wheel as viewed in the conveying direction. The sensor 5 is capable of detecting sheets, multiple sheets, and gaps between sheets. This sensor may detect any deviation from the normal conveying operation. This is a way to detect faults such as double sheets, early sheets, or late sheets. Various processes may be initiated as a function of the monitoring function and the type of the fault that has been detected. Fault sheets may be stopped by stopping the feed system before the sheet reaches the folding unit. Alternatively, fault sheets may be discharged without disturbing the feeding process by adapting the speed.

In a sheet feeder that includes a suction wheel 1 to which suction air is applied in a cyclical way and which carries out a controlled rotary movement, the process of attracting a sheet by suction may occur when the suction wheel is at a standstill (resting period). Taking into account the maximum suction period, the beginning of the sheet-conveying process on the suction wheel may be determined in such a way that the sheet rests against the suction wheel in a force-locking way before the rotary movement starts. This avoids suction tolerances (tolerances pertaining to the distance between the sheet and the suction wheel, the creation of the vacuum, and slip). A force-locking connection is one which connects two elements together by force external to the elements, as opposed to a form-locking connection which is provided by the shapes of the elements themselves.

Since the suction wheel only rotates when sheets are being conveyed, it cannot cause friction marks on the sheets to be conveyed.

Furthermore, the sheet may be positioned in a type of stand-by condition using a cyclical suction wheel drive.

Sheets that have not been sucked up or suctioned correctly (fault sheets) may be transported against the conveying direction by a reversal of the direction of rotation of the suction wheel and may thus be discharged or shaken loose and subsequently accelerated in a controlled way.

The invention claimed is:

1. A sheet feeder for separating sheets, including sheets of paper, cardboard and plastic, from a stack having front and rear edges and for feeding the sheets in a sheet travel direction in a sheet travel plane to a downstream sheet processing machine, the sheet feeder comprising:

a first suction wheel disposed above the stack and having an axis of rotation;

a second suction wheel disposed downstream of said first suction wheel in the sheet travel direction, disposed downstream of the stack, disposed above or below the sheet travel plane and having an axis of rotation;

a separation device disposed in vicinity of the rear edge of the stack and configured to lift a respective uppermost sheet off the stack; and said axis of rotation of said first suction wheel disposed at a first distance from the rear edge of the stack, said axis of rotation of said second suction wheel disposed at a second distance from the front edge of the stack and said first distance being greater than or equal to said second distance;

said first suction wheel having a periphery with at least one suction and conveying section having a length, said first distance between said axis of rotation of said first suction wheel and the rear edge of the stack being equivalent to said length of said at least one suction and conveying section.

2. The sheet feeder according to claim 1, wherein:

said second suction wheel has an average rotational speed being higher than or equal to an average rotational speed of said first suction wheel; and a current rotational speed of said second suction wheel is always higher than or equal to a current rotational speed of said first suction wheel.

3. The sheet feeder according to claim 1, which further comprises a vacuum source connected at least to said first suction wheel and configured to continuously supply suction air to said first suction wheel.

4. The sheet feeder according to claim 1, which further comprises a drive connected to said first suction wheel and configured to rotate said first suction wheel at a constant rotational speed.

5. The sheet feeder according to claim 1, which further comprises a vacuum source connected to said first suction wheel and configured to cyclically supply suction air to said first suction wheel.

6. The sheet feeder according to claim 5, wherein said vacuum source is configured to provide three cycles: attracting the sheet by suction, holding the sheet, and releasing the sheet.

7. The sheet feeder according to claim 6, which further comprises:

a machine control unit and a servomotor configured to drive said first suction wheel;

a data exchange connection connected between said servomotor and said machine control unit; and said servomotor configured to be actuatable to impart a rotary movement to said first suction wheel during said cycle of holding the sheet.

8. The sheet feeder according to claim 7, wherein said data exchange connection is a data line.

9. A sheet feeder for separating sheets, including sheets of paper, cardboard and plastic, from a stack having front and rear edges and for feeding the sheets in a sheet travel direction in a sheet travel plane to a downstream sheet processing machine, the sheet feeder comprising:

a first suction wheel disposed above the stack and having an axis of rotation;

a second suction wheel disposed downstream of said first suction wheel in the sheet travel direction, disposed downstream of the stack, disposed above or below the sheet travel plane and having an axis of rotation;

a separation device disposed in vicinity of the rear edge of the stack and configured to lift a respective uppermost sheet off the stack; and said axis of rotation of said first suction wheel disposed at a first distance from the rear edge of the stack, said axis of rotation of said second suction wheel disposed at a second distance from the front edge of the stack and said first distance being greater than or equal to said second distance;

said first suction wheel having a periphery with at least one suction and conveying section having a length and at least one suctionless release section for transferring the sheet to said second suction wheel, said first distance between said axis of rotation of said first suction wheel and the rear edge of the stack being equivalent to said length of said at least one suction and conveying section.

* * * * *